US007669298B2

(12) United States Patent
Chen

(10) Patent No.: US 7,669,298 B2
(45) Date of Patent: Mar. 2, 2010

(54) BUCKLE ASSEMBLY

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 518 days.

(21) Appl. No.: 11/477,621

(22) Filed: Jun. 30, 2006

(65) Prior Publication Data

US 2007/0137009 A1 Jun. 21, 2007

(30) Foreign Application Priority Data

Dec. 21, 2005 (CN) ..... 2005 2 0132188 U

(51) Int. Cl.
*A44B 11/25* (2006.01)

(52) U.S. Cl. ..... 24/630; 24/579.11

(58) Field of Classification Search ..... 24/579.11, 24/614, 615, 616, 625, 632, 662
See application file for complete search history.

(56) References Cited

U.S. PATENT DOCUMENTS

| | | | | |
|---|---|---|---|---|
| 4,035,877 | A * | 7/1977 | Brownson et al. | 24/633 |
| 4,302,049 | A * | 11/1981 | Simpson | 24/632 |
| 4,644,618 | A * | 2/1987 | Holmberg et al. | 24/632 |
| 4,809,410 | A * | 3/1989 | Van Riesen | 24/579.11 |
| 5,170,539 | A * | 12/1992 | Lundstedt et al. | 24/196 |
| 5,471,714 | A * | 12/1995 | Olson | 24/196 |
| 6,543,101 | B2 * | 4/2003 | Sack et al. | 24/633 |
| D552,014 | S * | 10/2007 | Chen et al. | D11/216 |
| 2002/0007539 | A1 * | 1/2002 | Sack et al. | 24/614 |
| 2005/0125970 | A1 | 6/2005 | Nolan | |

FOREIGN PATENT DOCUMENTS

| | | |
|---|---|---|
| DE | 88 02 258 | 9/1988 |
| EP | 0 137 374 | 4/1985 |
| GB | 2 286 851 A | 8/1995 |
| WO | 01/54529 A2 | 8/2001 |

* cited by examiner

*Primary Examiner*—Robert J Sandy
(74) *Attorney, Agent, or Firm*—Bacon & Thomas, PLLC

(57) ABSTRACT

A buckle assembly for connecting safety belts according to one embodiment of the present invention is provided. The buckle assembly includes a buckle body including two side openings; a release button disposed in the buckle body including an engaging portion; two shoulder-strap buckles each having an opening to allow the waist-strap buckles passing through; and two waist-strap buckles each having a prong portion; wherein each of the shoulder-strap buckles is respectively positioned between each of the waist-strap buckles and the buckle body and incapable of departing from the buckle body freely when the prong portion of the waist-strap buckle is received in each of the side openings of the buckle body and engaged with the engaging portion of the release button; and the shoulder-strap buckles are departed from the buckle body together with the waist-strap buckles when the release button is actuated.

14 Claims, 5 Drawing Sheets

BUCKLE ASSEMBLY

BACKGROUND OF THE INVENTION

1. Field of the Invention

The present invention relates generally to a buckle assembly, and more particularly to a buckle assembly for safety belts of a children seat.

2. Art Background

Some conventional buckle structures are typically utilized for safety belts of an automobile, strollers for children and safety belts of a children seat. In the related prior arts, a buckle assembly usually includes an engagement portion disposed in the shoulder-strap buckles for engaging with the waist-strap buckles, wherein the waist-strap buckles are inserted into the buckle body after being engaged with the shoulder-strap buckles so as to achieve the operation of engagement. For instance, U.S. Pat. No. 6,543,101 discloses a multi-point buckle assembly including a body, a plurality of side openings, a plurality of channels, a release button and a plurality of side tongues. Besides, US Publication No. 2005-0125970-A1 discloses the above-mentioned type of buckle assembly. However, a buckle assembly according to an embodiment of the present invention is provided such that the waist-strap buckles are inserted into the buckle body through the shoulder-strap buckles, and the shoulder-strap buckles are incapable of departing from the buckle assembly freely by engaging the release button with the waist-strap buckles, and the waist-straps are removed from the buckle body together with the shoulder-strap buckles when the release button is actuated.

In general, the above-mentioned prior art has some problems and shortcomings on its operation and reliability, and besides, the conventional buckle assembly is usually expensive, and hard in manufacture and combination. In order to overcome the problems described above, a buckle assembly according to an embodiment of the present invention is provided such that the buckle assembly includes the purposes and functions of simple structure, low cost, easy operation, and firm engagement, in addition to the basic functions of connecting and securing the safety belts.

SUMMARY OF THE INVENTION

Accordingly, one object of the present invention is to provide a buckle assembly that is of firm engagement, easy in manufacture and combination.

One object of the present invention is to provide a buckle assembly having particular shoulder-strap buckles.

A further object of the present invention is to provide a buckle assembly, such that the waist-strap buckle is passed through the shoulder-strap buckle and inserted into the buckle body to achieve the engagement.

To achieve these and other objects, a buckle assembly for connecting safety belts is provided, and the buckle assembly comprising: a buckle body including two side openings; a release button disposed in the buckle body including an engaging portion; two shoulder-strap buckles each having an opening to allow the waist-strap buckles passing through; and two waist-strap buckles each having a prong portion; wherein each of the shoulder-strap buckles is respectively positioned between each of the waist-strap buckles and the buckle body and incapable of departing from the buckle body freely when the prong portion of the waist-strap buckle is received in each of the side openings of the buckle body and engaged with the engaging portion of the release button; and the shoulder-strap buckles are departed from the buckle body together with the waist-strap buckles when the release button is actuated.

It is preferred that the release button further comprising two elastic members for ejecting the waist-strap buckles respectively when the release button is pressed.

It is preferred that each of the waist-strap buckles further comprising an inclined surface corresponding to the elastic members of the release button.

It is preferred that each of the prong portions includes two arm-shaped prong members and one end of each the prong members includes a hook-shaped portion protruded laterally, the hook-shaped portion is engaged with the engaging portion of the release button.

It is preferred that an inclined surface is mounted between the prong members; the release button comprising two elastic members in aid of ejecting the waist-strap buckles respectively by depressing against the inclined surface.

It is preferred that the buckle body further comprising two guiding members and each of the prong members further comprising a groove configured to be glidingly engaged with the guiding member.

It is preferred that the buckle body comprising a top opening on a top surface and the release button comprising a top surface which is positioned within the top opening of the buckle body, and the elastic members are hook-shaped and connected to the top surface at two sides respectively.

It is preferred that the waist-strap buckles further comprising a frame body and each of the prong portions is extended from a side of the frame body.

It is preferred that each of the prong portions including two prong members which has a hook-shaped portion in one side.

It is preferred that the waist-strap buckles further comprising a chamber at another side of the frame body, and the chamber is connected to an adjusting device for adjusting safety belts.

It is preferred that the shoulder-strap buckles further comprising a shoulder-strap through groove to allow shoulder straps passing through, and the shoulder-strap through groove is substantively perpendicular to the opening.

It is preferred that each of the shoulder-strap buckles further comprising an inclined surface disposed between the shoulder-strap through groove and the opening and extended toward two sides from the opening, and the inclined surface of the shoulder-strap buckles is contacted with an outer wall of the buckle body.

Besides, a buckle assembly for connecting safety belts according to another embodiment is provided, and the buckle assembly comprising: a waist-strap buckle including a prong portion; a buckle body including a side opening for receiving the prong portion and is configured to engage with the prong portion; and a shoulder-strap buckle is positioned between the waist-strap buckle and the buckle body; wherein the shoulder-strap buckle having an opening to allow the prong portion of the waist-strap buckle pass through to receive in the side opening of the buckle body.

It is preferred that a button is disposed on the buckle body and the button including an engaging portion for engaging the prong portion of the waist-strap buckle.

It is preferred that the waist-strap buckle including a frame body for attaching a strap, the prong portion including two arm-shaped prong members extended from one side of the frame body; the shoulder-strap buckle is positioned between the frame body and the buckle body while the prong members are engaged with the buckle body.

It is preferred that the waist-strap buckle including an inclined surface mounted between the prong members; the buckle body including a top opening; and a button mounted on the buckle body having a top surface within the top opening, two hook-shaped elastic members connected to the top surface for abutting the inclined surface of the waist-strap buckle and an engaging portion disposed beneath the top surface for engaging the prong portion.

It is to be understood that both the forgoing general description and the following detailed description are exemplary and explanatory and are intended to provide a further non-limiting explanation of the invention as claimed.

BRIEF DESCRIPTION OF THE DRAWINGS

For a more complete understanding of the present invention and the advantages thereof, reference is now made to the following description taken in conjunction with the accompanying drawings, wherein.

DETAILED DESCRIPTION

Figure 1:
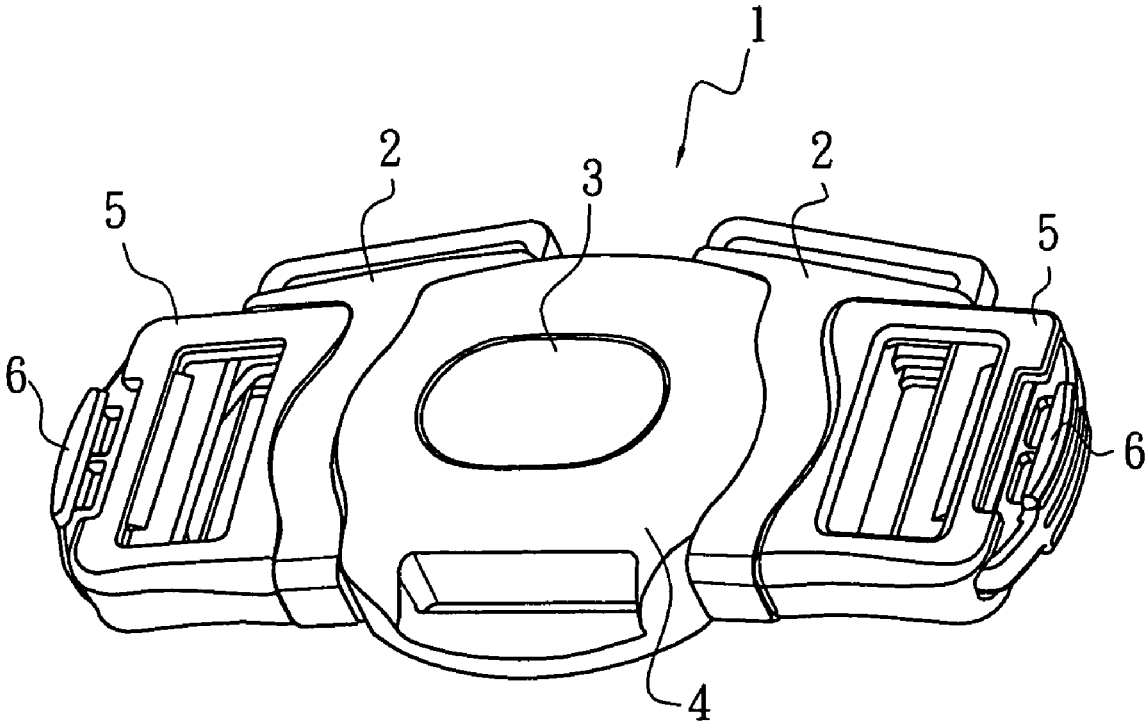
FIG. 1 is a schematic view illustrating the entire appearance of the buckle assembly 1 according to an embodiment of the present invention.

Referring now to the drawings in which an embodiment of the present invention is illustrated to describe the present invention.

The Main Structure of the Buckle Assembly

First, the entire appearance of the buckle assembly and its structure according to an embodiment of the present invention will be set forth in the description. As shown in FIG. 1, the buckle assembly 1 mainly includes two shoulder-strap buckles 2 (at two sides), a release button 3, a buckle body 4, two waist-strap buckles 5 (at two sides) and two adjusting devices 6 (at two sides). In addition, it should be appreciated that since some parts of the buckle assembly 1 includes two portions at two sides, and thus some reference numbers in the drawings of the present invention will be omitted for the purposes of clear illustration.

Figure 2:
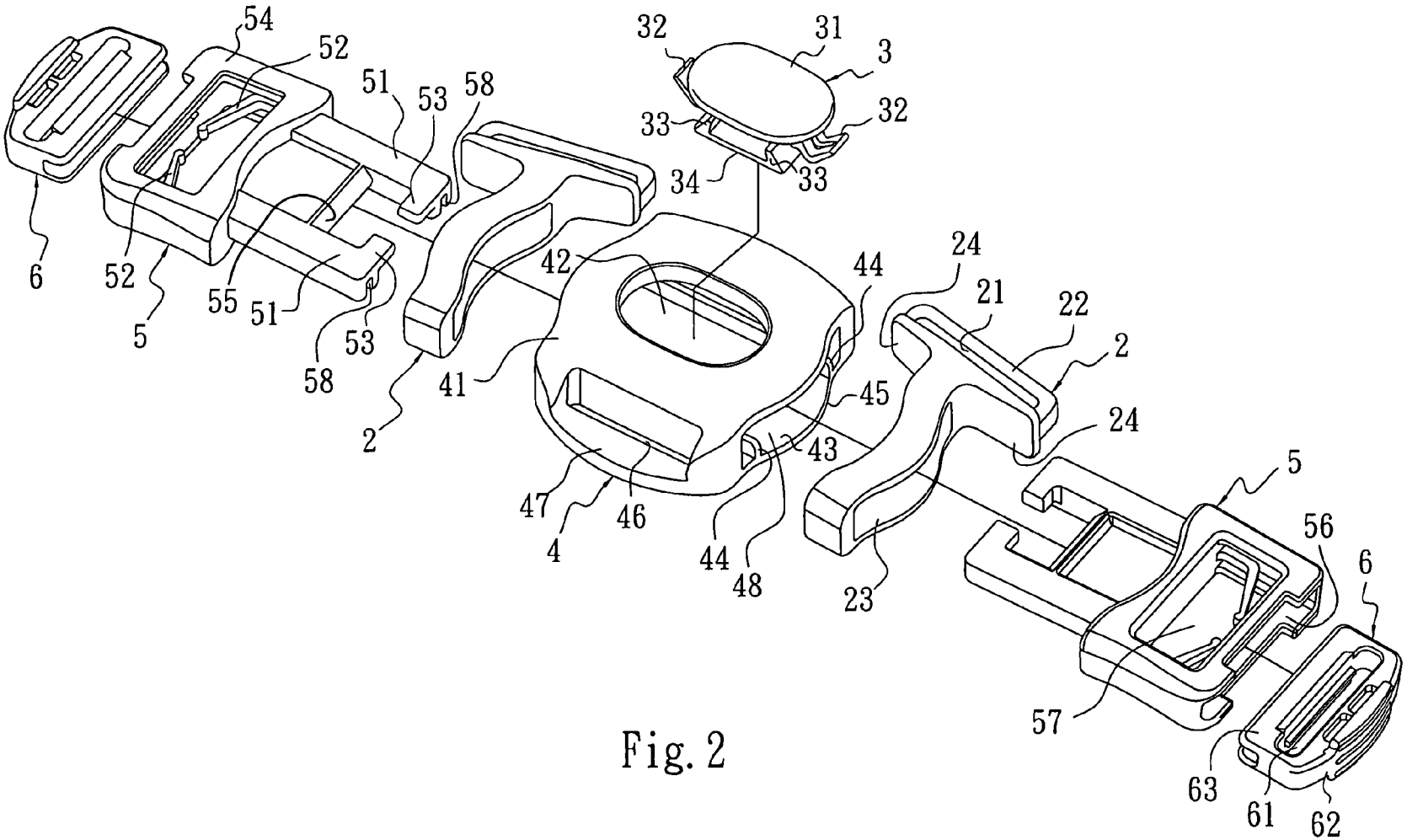
FIG. 2 is an explosive view illustrating the buckle assembly 1 according to an embodiment of the present invention.

As shown in FIG. 2, each members of the buckle assembly 1 will be described in the following. Each of the shoulder-strap buckles 2 includes a frame body 22 disposed at upper side of the shoulder-strap buckles 2, a through groove 21 defined by the frame body 22, an opening 23 disposed beneath the through groove 21, and two inclined surfaces 24, wherein each of the inclined surfaces 24 is a rectangular and flat surface, each of the inclined surfaces 24 is disposed between the through groove 21 and the opening 23 and extended toward two sides from a top portion of the opening 23. It should be appreciated that the through groove 21 is substantively perpendicular to the opening 23 in this preferred embodiment of the present invention. Next, the release button 3 includes an elliptic top surface 31, two hook-shaped elastic members 32 connected to the top surface 31, an engaging portion 33 disposed beneath the top surface 31, and a flat bottom surface 34 connected to the lower part of the engaging portion 33; and the engaging portion 33 consists of two protruding portions in this preferred embodiment of the present invention. The buckle body 4 includes a top surface 41, a bottom surface 45, a top opening 42 disposed on the top surface 41, two side openings 43 disposed at the left and right sides of the buckle body 4, a platform 47 disposed at the front side of the buckle body 4, and two guiding members 44 disposed at two ends of the bottom surface 45, wherein the top surface 41 and the bottom surface 45 form a chamber 48, and the chamber 48 is communicated with the top opening 42 and the side openings 43; the top surface 41 is connected to one end of the bottom surface 45 and extended to the platform 47, the top opening 42 is substantively corresponding to the elliptic top surface 31 of the release button 3, and the platform 47 includes a groove 46.

Next, each of the waist-strap buckles 5 includes a prong portion 51, a square frame body 54, a chamber 56 and two elastic legs 52, wherein the prong portion 51 is extended from one side of the frame body 54, and the chamber 56 is disposed another side of the frame body 54. It should be appreciated that the prong portion 51 consists of two arm-shaped prong members in this preferred embodiment of the present invention, and there is an inclined surface 55 between the two prong members. In addition, each of the prong members includes a hook-shaped portion 53 which is protruded laterally, each of the bottom surfaces of the prong portion 51 includes a guiding groove 58, an opening 57 is disposed within the frame body 54 utilized to communicate with the chamber 56, and each of the elastic legs 52 is disposed on the frame body 54 and extended toward the opening 57. Further, each of the adjusting devices 6 includes a waist-strap through groove 61, an actuating portion 62 and a contact portion 63 opposite to the actuating portion 62, wherein the adjusting device 6 is inserted into the waist-strap buckles 5 from the chamber 56, and the contact portion 63 is abutted with the elastic legs 52. When the contact portion 63 of the adjusting devices 6 is fully inserted within the chamber 56, a waist strap can be inserted up through the opening 57 of the waist-strap buckle 5, around the contact portion 63, through the waist-strap through groove 61 and back out of the opening 57 so as to be adjusted to a desired length by pressing the actuating portion 62 of the adjusting device 6.

Figure 3:
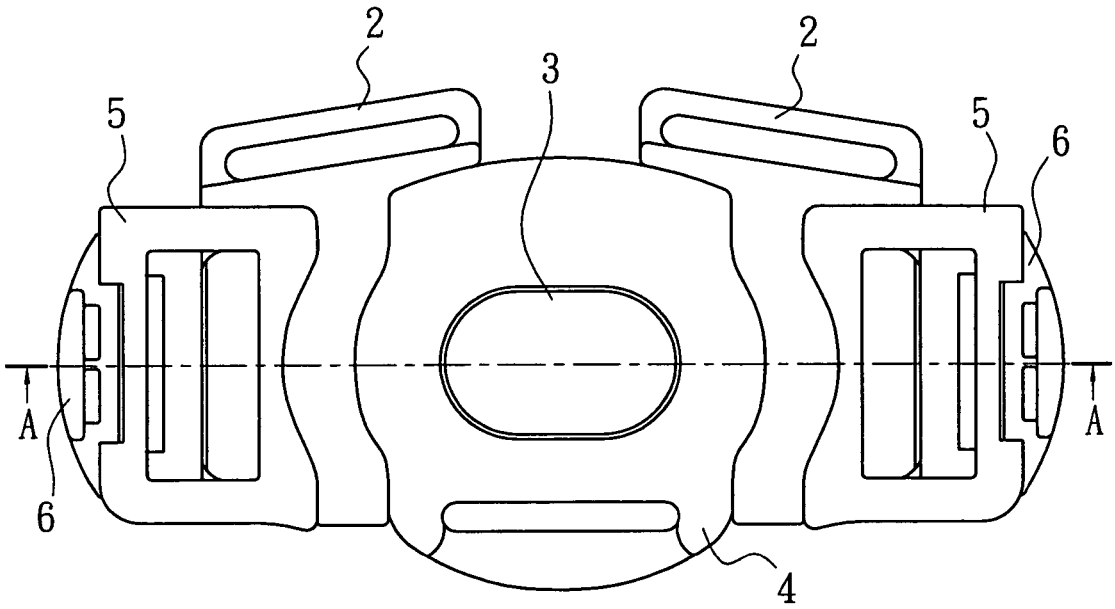
FIG. 3 is a top view illustrating the buckle assembly 1 according to an embodiment of the present invention.
Figure 4:
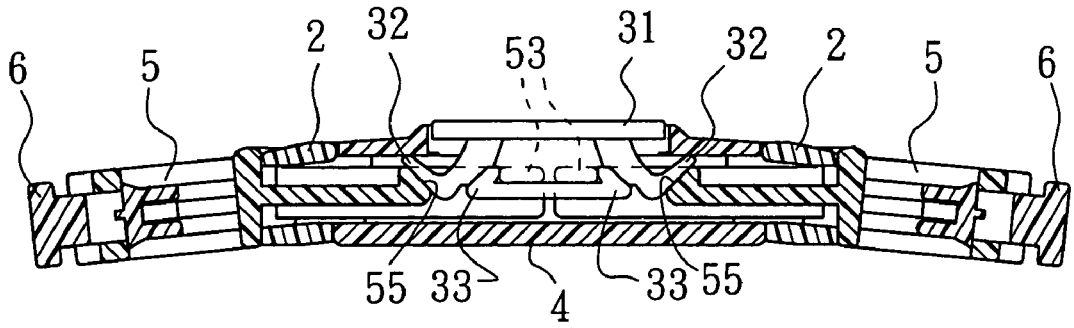
FIG. 4 is a cross-sectional view along with line A-A in FIG. 3 for illustrating the engagement condition of the buckle assembly 1 according to an embodiment of the present invention.

The opening 23 of the shoulder-strap buckles 2 allows the prong portion 51 of the waist-strap buckles 5 passing through, wherein the prong portion 51 can be inserted into the buckle body 4 accordingly, and the through groove 21 is mainly utilized for connecting to the shoulder strap (not shown in the figures). As shown in FIGS. 3 and 4, the release button 3 is disposed in the buckle body 4 from the top opening 42, wherein the release button 3 is retained in the buckle body 4 and can move freely within the chamber 48 of the buckle body 4 without additional force. The elastic members 32 of the release button 3 aid in ejection of the waist-strap buckle 5 by pressing the inclined surface 55 of the waist-strap buckle 5. The groove 46 of the buckle body 4 and the opening 57 of the waist-strap buckle 5 is utilized to allow a crotch strap and a waist strap (not shown in the figures) passing through respectively.

The Operation of the Buckle Assembly

Figure 5:
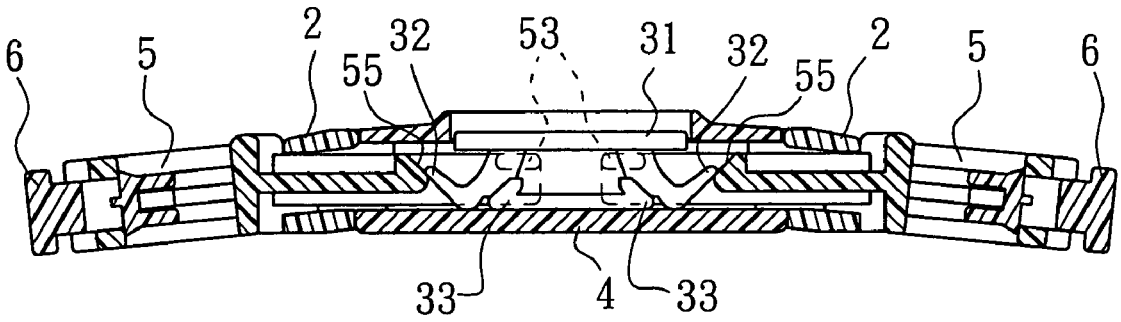
FIG. 5 is a cross-sectional view along with line A-A in FIG. 3 for illustrating the disengagement condition of the buckle assembly 1 according to an embodiment of the present invention.
Figure 6:
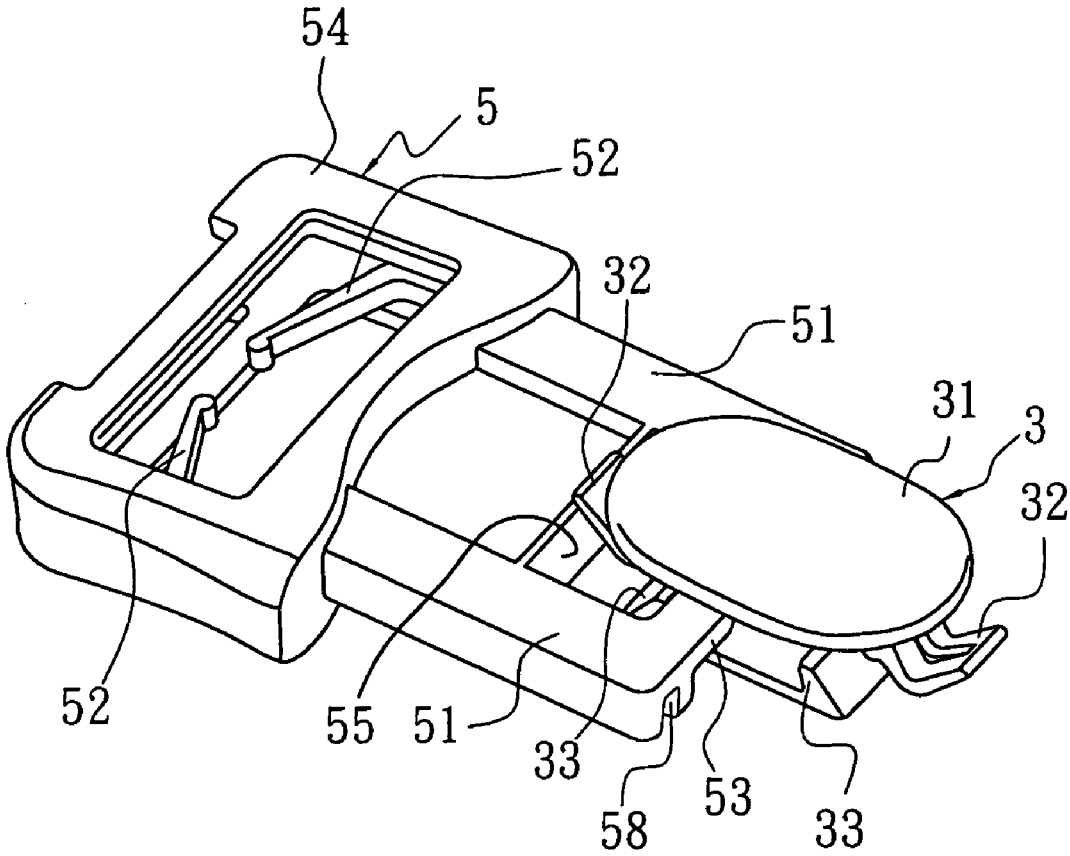
FIG. 6 is a top view illustrating the partly sectional view of the buckle assembly 1 according to an embodiment of the present invention, and the buckle body 4 and the shoulder-strap buckle 2 are omitted in FIG. 6 for simply showing the engagement between the waist-strap buckle 5 and release button 3.

In the following, the operation method of the buckle assembly 1 according to an embodiment of the present invention will be described. FIG. 3 is a top view illustrating the buckle assembly 1 according to an embodiment of the present invention, wherein line A-A is a cross-sectional line and each of FIGS. 4 and 5 is the cross-sectional view along with line A-A in FIG. 3 for illustrating the engagement and disengagement conditions of the buckle assembly 1 respectively. First, as shown in FIGS. 4 and 6, when a user intends to engage the members of the buckle assembly 1, the prong portion 51 of the waist-strap buckle 5 is passed through the opening 23 of the shoulder-strap buckle 2 for inserting the prong portion 51 of the waist-strap buckle 5 into one of the two side openings 43 of the buckle body 4 and is guided into the chamber 48 by sliding engagement between the guiding groove 58 of the prong portion 51 and the guiding members 44 of the buckle body 4. The hook-shaped portion 53 of the prong member is engaged with the engaging portion 33 of the release button 3 after entering the chamber 48, wherein the waist-strap buckle 5 will drive the release button 3 upward and the top surface 31 is parallel or protruded to the top opening 42 accordingly. Furthermore, as shown in FIG. 6, each of the two elastic members 32 of the release button 3 is respectively abutted the two inclined surfaces 55 of the waist-strap buckle 5, and the inclined surface 24 of the shoulder-strap buckle 2 is contacted with the outer wall of the buckle body 4 and the frame body 54 of the waist-strap buckle 5. Thus, the buckle assembly 1 is in a stable engagement condition and the shoulder-strap buckle 2 is positioned between the waist-strap buckle 5 and the buckle body 4 and it could not be removed from the buckle assembly 1 freely.

Next, as shown in FIG. 5, when a user intends to take apart the waist-strap buckle 5 and the shoulder-strap buckle 2 from the buckle body 4, he/she press the top surface 31 of the release button 3 and the elastic members 32 are depressed against the inclined surfaces 55 of the waist-strap buckle 5. When the release button 3 is moved downwardly, the hook-shaped portion 53 of the prong member is disengaged from the engaging portion 33. The waist-strap buckle 5 is ejected from the buckle body 4 and the shoulder-strap buckle 2 is removed from the buckle body 4 simultaneously therewith the buckle assembly 1 is in a disengagement condition.

According to the above-mentioned, a user can make the buckle assembly 1 to maintain in an engagement condition and a disengagement condition by actuating the release button release 3, thus the operation method of buckle assembly 1 of the present invention and its structure are indeed different with the related prior arts and the improved buckle assembly could indeed achieve the purposes and the features of the present invention.

The above-described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

What is claimed is:

1. A buckle assembly for connecting safety belts, comprising:

a buckle body including two side openings;

a release button disposed in said buckle body including an engaging portion and an ejecting portion;

two waist-strap buckles each having a prong portion; and two shoulder-strap buckles each having an opening to allow each of said waist-strap buckles to pass therethrough;

wherein said waist-strap buckle further comprises a frame body having an opening, a chamber and a spring device, said prong portion of said waist-strap buckle is extended from a side of said frame body, said chamber is formed at another side of said frame body and connected to an adjusting device for adjusting safety belts, and said spring device is disposed on said frame body and extended toward said opening of said frame body, and wherein each of said shoulder-strap buckles is respectively positioned between each of said waist-strap buckles and said buckle body and incapable of departing from said buckle body freely when said prong portion of said waist-strap buckle is received in each of said side openings of said buckle body and engaged with said engaging portion of said release button; and said shoulder-strap buckles are departed from said buckle body together with said waist-strap buckles when said release button is actuated to eject said waist-strap buckles.

2. The buckle assembly according to claim 1, wherein said ejecting portion of said release button further comprising two elastic members for ejecting said waist-strap buckles respectively when said release button is pressed.

3. The buckle assembly according to claim 2, wherein each of said waist-strap buckles further comprising an inclined surface corresponding to said elastic members of said release button.

4. The buckle assembly according to claim 2, wherein said buckle body comprising a top opening on a top surface and said release button comprising a top surface which is positioned within said top opening of said buckle body, and said elastic members are hook-shaped and connected to said top surface at two sides respectively.

5. The buckle assembly according to claim 1, wherein each of said prong portions includes two arm-shaped prong members and one end of each said prong members includes a hook-shaped portion protruded laterally, said hook-shaped portion is engaged with said engaging portion of said release button.

6. The buckle assembly according to claim 5, wherein an inclined surface is mounted between said prong members; said release button comprising two elastic members in aid of ejecting said waist-strap buckles respectively by depressing against said inclined surface.

7. The buckle assembly according to claim 5, wherein said buckle body further comprising two guiding members and each of said prong members further comprising a groove configured to be glidingly engaged with said guiding member.

8. The buckle assembly according to claim 1, wherein each of said prong portions comprising two prong members which has a hook-shaped portion in one side.

9. The buckle assembly according to claim 1, wherein said shoulder-strap buckles further comprising a shoulder-strap through groove to allow shoulder straps passing through, and said shoulder-strap through groove is substantively perpendicular to said opening.

10. The buckle assembly according to claim 9, wherein each of said shoulder-strap buckles further comprising an inclined surface disposed between said shoulder-strap through groove and said opening and extended toward two sides from said opening, and said inclined surface of said shoulder-strap buckles is contacted with an outer wall of said buckle body.

11. A buckle assembly for attaching straps, comprising:

a waist-strap buckle including a prong portion;

a buckle body including a side opening for receiving said prong portion and a top opening being adapted to receive a button, said button including an ejection portion; and a shoulder-strap buckle having an opening to allow said prong portion of said waist-strap buckle to pass therethrough;

wherein said waist-strap buckle further comprises a frame body having an opening, a chamber and a spring device, said prong portion of said waist-strap buckle is extended from a side of said frame body, said chamber is formed at another side of said frame body and connected to an adjusting device for adjusting safety belts, and said spring device is disposed on said frame body and extended toward said opening of said frame body, and wherein said shoulder-strap buckle is positioned between said waist-strap buckle and said buckle body when said waist-strap buckle is secured to said buckle body and said shoulder-strap buckle is removed from said buckle body simultaneously with said waist-strap buckle when said button is pressed and said waist-strap buckle is ejected from said buckle body by said ejecting portion.

12. The buckle assembly according to claim 11, wherein said button is disposed on said buckle body and said button including an engaging portion for engaging said prong portion of said waist-strap buckle.

13. The buckle assembly according to claim 11, wherein said prong portion including two arm-shaped prong members extended from one side of said frame body; said shoulder-strap buckle is positioned between said frame body and said buckle body while said prong members are engaged with said buckle body.

14. The buckle assembly according to claim 13, wherein said waist-strap buckle including an inclined surface mounted between said prong members; and said button mounted on said buckle body having a top surface within said top opening, two hook-shaped elastic members connected to the top surface for abutting said inclined surface of said waist-strap buckle and an engaging portion disposed beneath said top surface for engaging said prong portion.

* * * * *